United States Patent [19]

Sedlmair

[11] Patent Number: 4,930,802

[45] Date of Patent: Jun. 5, 1990

[54] TOE PIECE FOR SAFETY SKI-BINDING

[75] Inventor: Gerhard Sedlmair, Farchant, Fed. Rep. of Germany

[73] Assignee: Marker Deutschland GmbH, Eschenlohe, Fed. Rep. of Germany

[21] Appl. No.: 131,744

[22] Filed: Dec. 11, 1987

[30] Foreign Application Priority Data

Dec. 16, 1986 [DE] Fed. Rep. of Germany ... 8633619[U]

[51] Int. Cl.[5] ..... A63C 9/085

[52] U.S. Cl. ..... 280/625; 280/629; 280/634

[58] Field of Search ..... 280/625, 629, 634, 636

[56] References Cited

U.S. PATENT DOCUMENTS

| | | | |
|---|---|---|---|
| 3,787,070 | 1/1974 | Salomon | 280/629 |
| 3,854,741 | 12/1974 | Marker et al. | 280/625 |
| 3,902,730 | 9/1975 | Tschida et al. | 280/625 |
| 3,910,592 | 10/1975 | Sittmann | 280/625 |
| 4,660,849 | 4/1987 | Sedlmair et al. . | |
| 4,685,696 | 8/1987 | Sedlmair et al. . | |
| 4,728,117 | 3/1988 | Stepanek . | |
| 4,735,434 | 4/1988 | Sedlmair | 280/629 X |
| 4,735,435 | 4/1988 | Sedlmair | 280/625 |

FOREIGN PATENT DOCUMENTS

| | | | |
|---|---|---|---|
| 714441 | 7/1965 | Canada | 280/625 |
| 2255604 | 5/1974 | Fed. Rep. of Germany | 280/625 |
| 1372663 | 8/1964 | France | 280/629 |

*Primary Examiner*—Charles A. Marmor
*Assistant Examiner*—Tamara L. Finlay
*Attorney, Agent, or Firm*—D. Peter Hochberg; Mark M. Kusner; Louis J. Weisz

[57] ABSTRACT

In accordance with the present invention, there is provided a toe piece for holding a ski-boot in a safety ski-binding, which toe piece is pivotable against a biasing force when excessive side forces occur. The toe piece includes a base plate, a housing mountable to the base plate and a pair of elongated, generally parallel side members, each pivotally mounted at one end of the base plate. A coupling member pivotally connects the other ends of the side members to each other to form a linkage. The linkage is laterally movable relative to the base plate about the pivotally mounted ends of the side members. A detent assembly operable against a biasing force is provided for centering the linkage. The toe piece also includes a pair of side boot holders pivotally connected to the coupling member. A lever centrally located relative to the side boot holders has end portions in operative engagement with the side boot holder. The lever is pivotally mounted on the linkage for movement therewith and is operative to maintain the side boot holders in a boot holding position when the lever is in a first position and to allow movement of a side holder to a boot releasing position when the lever is in a second position. A lever actuating member extends from the housing in a fixed position relative to the longitudinal axis of the ski. Control members are provided on the end portions of the lever to operatively engage the lever actuating member such that when the linkage moves beyond a predetermined distance from center, the lever moves from the first position to the second position thereby releasing the side boot holder on the side to which the linkage moves.

4 Claims, 2 Drawing Sheets

TOE PIECE FOR SAFETY SKI-BINDING

FIELD OF THE INVENTION

The present invention relates to a toe piece for a safety ski binding, and more particularly to a safety ski-binding which is pivotable in a lateral direction against a biasing force when excessive side forces occur.

BACKGROUND OF THE INVENTION

German Patent Application No. P 3539969.4 (corresponding to U.S. Pat. No. 4,728,117 to Stepanek) discloses a toe piece for a safety ski binding including a detent device. The detent device is comprised of a spring-loaded detent roller, which extends into a detent depression formed on a link. The device is operable to hold a linkage in a normal, central position. A lever which includes a concave cam surface with an intermediate portion conforming to the detent depression of the link is also acted upon by the detent roller. The intermediate portion of the cam surface is adjoined at both ends by surface portions which are mirror images of each other and which protrude beyond the corresponding portions of the detent depression of the link. Compared to other known toe units having a linkage, the disclosed toe unit affords the advantage of having a simple and reliable structure. The present invention relates to further improvements with respect to the manufacture and function of such toe piece.

SUMMARY OF THE INVENTION

In accordance with the present invention, there is provided a toe piece for holding a ski-boot in a safety ski binding, which toe piece is pivotable against a biasing force when excessive side forces occur. The toe piece includes a base plate, and a pair of elongated, generally parallel side members, each pivotally mounted at one end on the base plate. Coupling means are provided to pivotally connect the other ends of the side members to each other to form a linkage. The linkage is laterally movable relative to the base plate about the pivotally mounted ends of said side member. Detent means operative against a biasing force are provided for centering the linkage. The toe piece also includes a pair of side boot holders pivotally connected to the coupling means, which side boot holders laterally hold the sole of a ski-boot. A lever is centrally located relative to the side boot holders and has end portions in operative engagement therewith. The lever is pivotally mounted on the linkage for movement therewith and is operative to maintain the side boot holders in a boot holding position when the lever is in a first position and to allow movement of a side holder to a boot releasing position when the lever is in a second position. Lever actuating means are mounted to the base plate in a fixed position relative to the longitudinal axis of the ski. Control members are provided on the end portions of the lever. The control members operatively engaging the lever actuating means wherein when the linkage moves beyond a predetermined distance from center, the lever moves from the first position to the second position thereby releasing the side boot holder on the side to which the linkage moves.

More specifically, in accordance with the present invention, the lever carries a control member on each end portion thereof, and the lever actuating means is a stop or cam which is fixed to the base plate. The cam is provided in the vertical plane of symmetry of the toe piece to engage and operate the control members on the lever. Importantly, because the lever is no longer acted upon by a detent roller which transmits a resistance opposing a release, the friction is appreciably reduced particularly in the so-called "elastic range" of the toe piece. The control members are preferably comprised of pins, which extend upwardly and are parallel to the axis of the lever so that the components can be held in a simple manner and can be made at low cost.

In accordance with another aspect of the present invention, the stop or cam is formed or otherwise provided on a cover portion of a housing for mounting on the base plate, and the detent device is disposed below the stop to provide a toe piece having a more compact structure.

BRIEF DESCRIPTION OF THE DRAWINGS

An illustrative embodiment of the present invention will now be described with reference to the accompanying drawing, in which.

DETAILED DESCRIPTION OF PREFERRED EMBODIMENT

Figure 1:
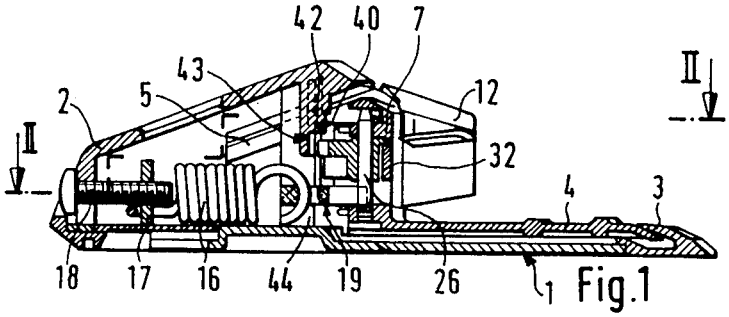
FIG. 1 is a sectional elevation view of a toe piece illustrating a preferred embodiment of the present invention.

Referring now to the drawings wherein the showing is for the purpose of illustrating a preferred embodiment, and not for the purpose of limiting same, a toe piece according to the present invention includes a housing which is comprised of a base 1 which is to be secured to the ski and of a cover 2 which is held on the base 1. As shown in the drawings, the base 1 extends to the right beyond the cover 2 and at its free end defines a claw 3 for retaining the free end of a pivoted pedal 4.

The housing includes a linkage, which is comprised of side members 5, 6 and a connecting link 7. Side members 5, 6 are movably mounted in the housing on a pivot pins 8, 9 respectively, which pins are at right angles to the plane of the ski. The pivot pins connecting the link 7 to the side members are designated 10, 11. In the embodiment shown, the pedal 4 is integral with the link 7, as is apparent from FIG. 1. Two screw holes 14 are formed in the base 1, and two corresponding fixing holes 15 are provided in the pedal 4 for securing the toe piece to the ski. The linkage is held in its normal position by a detent device. When excessive side forces are exerted thereon, the linkage is operable to shift laterally against a resistance which is maintained by the detent device. Such detent devices are conventionally known, and in and of itself forms no part of the present invention. A centering element 19 is pivotally movable in a horizontal plane and is biased by a helical tension spring 16 and via a coupling member 26 that is movably mounted with connecting link 7 holds the linkage in a normal, central position. A helical compression spring is hooked into a retaining plate 17, which is adjustably held in the housing on a screw 18.

Each of the pivot pins 10, 11 connecting the link 7 to side members 5, 6 carries a boot holding jaw 12, 13.

Boot holding jaws 12, 13 include arm portions 30, 31 that terminates in a rounded tip. Arm portions 30, 31 are normally in engagement with first surface portions 33, 34 of a two-armed lever 32, which is movably mounted on a coupling member 26. As a result, the side jaws 12, 13 cannot move outwardly relative to the link (see FIGS. 2 and 3).

First surface portions 33, 34 of the lever 32 are curved about the axis of the coupling member 26 and on the releasing side terminate in a sharp edge. Adjacent first surface portions 33, 34 are second surface portions 35, 36 which are concavely curved and serve as restoring surfaces for the arm 30, 31 of the respective boot holding jaws 12, 13. On the inside of the jaw, first surface portions 33, 34 are adjoined by third surface portions 37, 38, which serve as supporting surfaces in a manner which will be described hereinafter. Third surface portions 37, 38 are separated by a central recess 39 in lever 32.

At the ends of its arms, lever 32 includes upstanding pins 40, 41, which serve as a control member. Pins 40, 41 serve to cooperate with a fixed stop or cam 42, which lies in the vertical plane of symmetry of the toe piece. Stop 42 constitutes a portion of an extension 43, which extends from the cover cap 2 into the interior of the toe piece. The free end of that extension merges into two pins 44, which serve to connect the cover to the base 1. Below the stop 42 and on both sides thereof the extension 43 serves as an abutment for third surface portions 37, 38 of the lever 32. The length of third surface portions 37, 38 corresponds to the lateral extent over which the linkage is pivotally moved toward the side.

Figure 2:
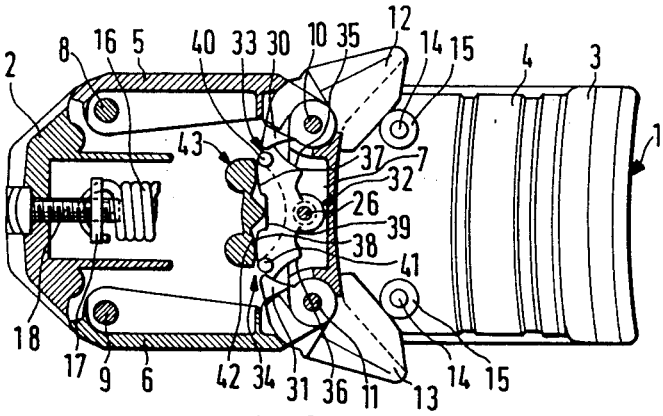
FIG. 2 is a sectional plan view taken on line II—II in FIG. 1.

The several parts of the toe unit normally assume the position shown in FIGS. 1 and 2. When a ski boot, not shown, exerts a force on boot holding jaw 13 which overcomes the initial stress of the helical compression spring, the linkage will pivotally move from a position as shown in FIG. 2, to the position shown in FIG. 3. During this pivotal movement, in what is referred to as the holder's "elastic range", boot holding jaws 12, 13 do not move relative to the link 7 of the linkage because their arms 30, 31 bear on the lever 32, which is movably mounted on the link 7. Under such conditions, if the force is reduced, the helical compression spring 16 returns the linkage to its initial position shown in FIG. 2.

Figure 3:
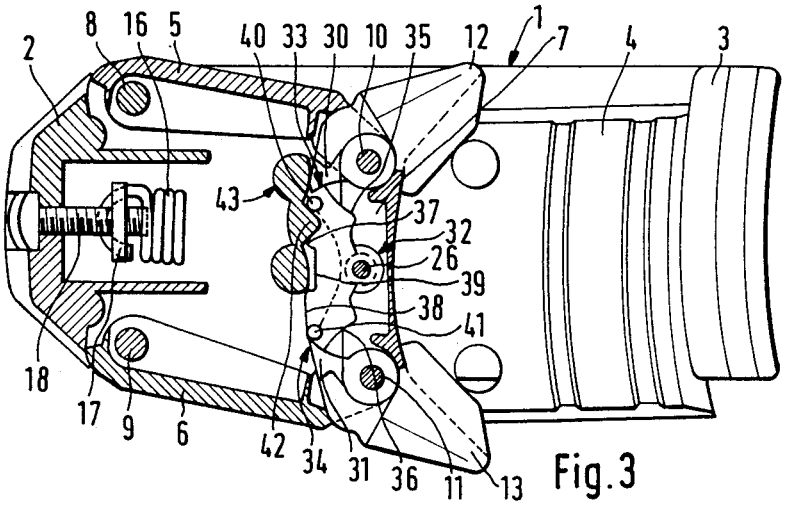
FIG. 3 is a sectional plan view similar to FIG. 2 showing the linkage in a shifted position.
Figure 4:
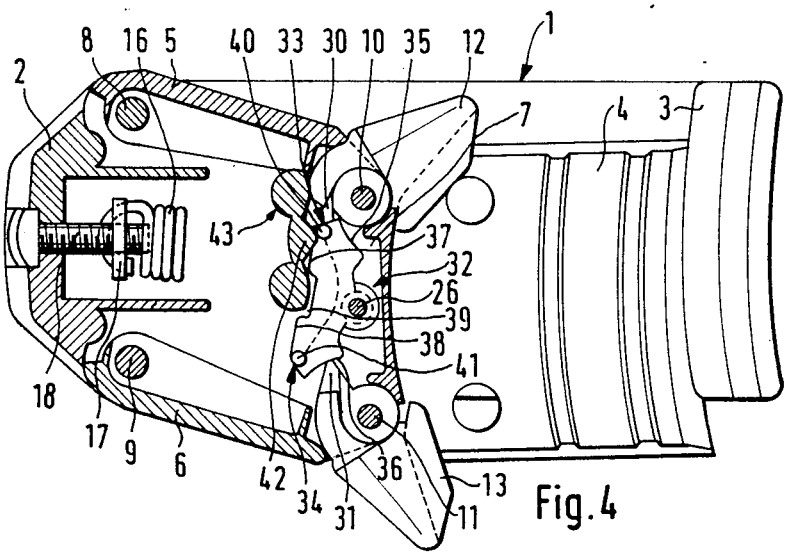
FIG. 4 is a sectional plan view similar to FIG. 3 showing the side boot holder in a boot releasing position.

FIG. 3 shows the toe unit in a position assumed closely before the release of the boot holding jaw 13. In this situation, because the application of the force and the pivotal movement of the linkage is continued, the pin 40 strikes against the stop 42 so that the lever 32 is pivotally moved relative to the link 7 about the coupling member 26 in the clockwise sense in the drawing. This is permitted because the supporting surface 38 has previously been disengaged from the extension 43. At the end of the outward pivotal movement of the lever 32, the end portion of the arm 31 of the side jaw 13 disengages first surface portion 34 of the lever 32 so that the side jaw can swing out about the pivot pin 11 as is shown in FIG. 4. In this position the boot can move away from the toe piece.

When the boot has been released, the linkage returns to its normal position. As the lever 32 is swung back, it simultaneously causes the side jaw 13 to swing back to its initial position.

The present invention has been described with respect to a preferred embodiment, modifications and alterations of which will occur to toher upon their reading and understanding of this specification. It is intended that all such modifications and alterations be included insofar as they come within the scope of the appended claims or the equivalents thereof.

Having thus defined the invention, the following is claimed:

1. A toe piece for holding a ski-boot in a safety ski binding, said toe piece being pivotable against a biasing force when excessive side forces occur, said toe piece including:

a base plate;

a pair of elongated, generally parallel side members, each pivotally mounted at one end on said base plate;

coupling means pivotally connecting the other ends of said side members to each other to form a linkage, said linkage being laterally movable relative to said base plate about said pivotally mounted ends of said side member;

a detent mechanism under the influence of a biasing force for centering said linkage;

a pair of side boot holders pivotally connected to said coupling means, said side boot holders laterally holding the sole of a boot;

a lever centrally located relative to said side boot holders having end portions in operative engagement therewith, said lever being pivotally mounted on said linkage for movement therewith and being operative to maintain said side boot holders in a boot holding position when said lever is in a first position and to allow movement of a side holder to a boot releasing position when said lever is in a second position;

a housing member mountable to said base plate;

lever actuating means extending from said housing member, said lever actuating means being disposed in a fixed position relative to the longitudinal axis of said ski; and control means on said end portions of said lever, said control means operatively engaging said lever actuating means wherein when said linkage moves beyond a predetermined distance from center, said lever moves from said first position to said second position thereby releasing said side boot holder on the side to which said linkage moves.

2. A toe piece as defined in claim 1 wherein said lever actuating means is a cam surface formed on the internal surface of said housing member.

3. A toe piece as defined in claim 1 wherein said control means are pins which extend upwardly and are parallel to the axis of said lever.

4. A toe piece as defined in claim 1 wherein said detent mechanism is disposed between said lever actuating means and said base plate.

* * * * *